US011541270B2

(12) United States Patent
Lomangino

(10) Patent No.: US 11,541,270 B2
(45) Date of Patent: Jan. 3, 2023

(54) ERGONOMIC EXERCISE EQUIPMENT HANDLE

(71) Applicant: Joseph Lomangino, Tallahassee, FL (US)

(72) Inventor: Joseph Lomangino, Tallahassee, FL (US)

( * ) Notice: Subject to any disclaimer, the term of this patent is extended or adjusted under 35 U.S.C. 154(b) by 102 days.

(21) Appl. No.: 17/085,127

(22) Filed: Oct. 30, 2020

(65) Prior Publication Data

US 2022/0134175 A1 May 5, 2022

(51) Int. Cl.
*A63B 21/00* (2006.01)

(52) U.S. Cl.
CPC ..... *A63B 21/4035* (2015.10); *A63B 21/151* (2013.01); *A63B 21/4039* (2015.10)

(58) Field of Classification Search
CPC ..... A63B 21/4035; A63B 21/151; A63B 21/4039
See application file for complete search history.

(56) References Cited

U.S. PATENT DOCUMENTS 1,012,802 A * 12/1911 Brogan ..... A63B 21/0004 482/91
1,112,114 A * 9/1914 Caines ..... A63B 21/0552 482/129
4,090,705 A 5/1978 Young
4,257,592 A * 3/1981 Jones ..... A63B 23/12 482/131
4,637,606 A * 1/1987 Hunn ..... A63B 5/20 482/82
5,556,369 A * 9/1996 Roberts ..... A63B 23/03541 482/904
5,718,654 A * 2/1998 Kennedy ..... A63B 21/4035 482/102
7,108,641 B2 * 9/2006 Pertegaz-Esteban ..... A63B 21/4017 482/92
7,473,213 B1 * 1/2009 Kallenbach ..... A63B 21/4017 16/428
8,715,147 B2 * 5/2014 Collins ..... A63B 21/0428 482/904
10,682,540 B2 6/2020 Mantione, III
10,695,609 B2 * 6/2020 Anastasi ..... A63B 21/068
2006/0035751 A1 2/2006 Blair et al.
2007/0010344 A1 1/2007 Mackay
2010/0113234 A1 * 5/2010 Kristiansen ..... A63B 21/4017 482/139

(Continued)

OTHER PUBLICATIONS

Earliest sale date based on review Apr. 15, 2019, Yes4All rotating pull up handles have foam grips and rotate 360 degrees. https://www.amazon.com/Yes4All-Rotating-Pull-Up-Handles/dp/B07JC43D2P/ref=cm_cr_arp_d_product_top?ie=UTF8.

*Primary Examiner* — Andrew S Lo
(74) *Attorney, Agent, or Firm* — Saile Ackerman LLC; Stephen B. Ackerman

(57) ABSTRACT

The goal of this invention is to provide an ergonomic handle for cable-based exercise equipment which is comfortable in the user's hands and increases user strength and range of motion. This exercise handle allows wrist flexion and extension as well as forearm and hand pronation and supination. The handle is composed of a grip which is rotatably coupled to a bracket, which is in turn connected to a rotatable connection assembly which freely rotates along an axis parallel to the cable.

7 Claims, 3 Drawing Sheets

(56) References Cited

U.S. PATENT DOCUMENTS

| | | | | |
|---|---|---|---|---|
| 2013/0157824 | A1* | 6/2013 | Chen | A63B 21/4033 482/142 |
| 2013/0165299 | A1* | 6/2013 | Hunt | A63B 5/20 482/82 |
| 2016/0256720 | A1* | 9/2016 | Grant | A63B 21/068 |
| 2017/0259110 | A1* | 9/2017 | Lomangino | A63B 21/00185 |
| 2019/0060706 | A1* | 2/2019 | Anastasi | A63B 21/4035 |
| 2019/0126092 | A1* | 5/2019 | Miller | A63B 21/4035 |

* cited by examiner

ERGONOMIC EXERCISE EQUIPMENT HANDLE

TECHNICAL FIELD

This application relates to the general field of exercise equipment, and more particularly, to an ergonomic swiveling handle for use with cable-based exercise equipment.

BACKGROUND

Present cable exercise equipment handles only allow motion in line with the cable, and most do not take the user's comfort into account. The user is forced to pull with unnaturally rigid wrist and elbow joints, applying excess strain to these areas and potentially leading to injuries.

Typical exercise equipment handles such as shown in FIG. 1, are made of plastic and are connected to the equipment via a nylon strap 12 which runs through the handle 10. With use over time the handle rubs against the nylon and the nylon eventually breaks. Also, if the user twists while pulling on the handle, this nylon strap undergoes torsion which also leads to its eventual breakage.

There have been a few attempts to create an ergonomic exercise equipment handle that change either the cross sectional or longitudinal shape of the handle.

SUMMARY

It is an object of the present disclosure to provide an ergonomic exercise equipment handle that will be comfortable in the user's hands.

It is a further object of the present disclosure to provide an exercise handle that allows wrist flexion and extension.

It is a further object of the present disclosure to provide an exercise handle that allows forearm and hand pronation and supination.

The above objects and others are achieved by an exercise handle for increasing user comfort and range of motion. An exercise equipment handle is provided including a grip, a bracket, wherein the grip is rotatably coupled to the bracket, and a rotatable connection assembly connected to the bracket, wherein after connection to cable-based exercise equipment and when in use, the rotatable connection assembly freely rotates along a first axis parallel to its connection to the cable-based exercise equipment, and wherein said grip freely rotates along a second axis perpendicular to the first axis. Additionally, the handle is assembled in such a way as to allow grips which differ in size or shape to be easily interchanged.

BRIEF DESCRIPTION OF THE DRAWINGS

In the accompanying drawings forming a material part of this description, there is shown.

DETAILED DESCRIPTION

Figure 2A:
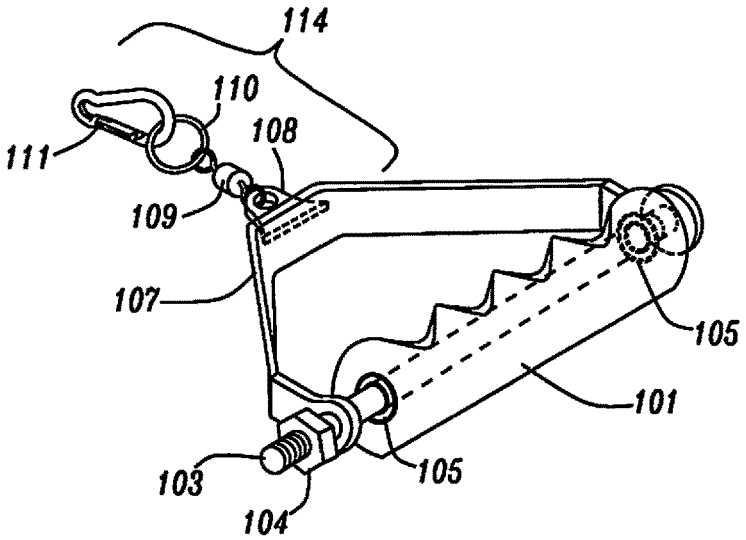
FIG. 2A illustrates a perspective view of a preferred embodiment of the present disclosure.

FIG. 2A is a perspective view of a preferred embodiment of the disclosed ergonomic exercise equipment handle, in assembled form. There is a pair of bearings 105, with a single bearing embedded within each end of the grip 101, which all fits between the ends of the bracket 107. The bracket preferably has a triangular shape, as shown in FIG. 2A. A threaded rod 103 slides through one end of bracket 107, through one bearing 105, through the grip 101, through the other bearing 105, through the other end of bracket 107, and is tightened in place by nut 104.

A connection sub-assembly 114 is used to connect the bracket 107 to exercise equipment. In one embodiment, a piece of metal plate with a center hole 108 is welded onto the far end of bracket 107. A pin bearing with a loop on either end 109 connects to the metal plate 108 on one end and to a metal ring 110 on the other end. The metal ring 110 connects to the exercise equipment cable, normally via a carabiner 111 which is typically permanently connected to the cable.

Figure 5A:
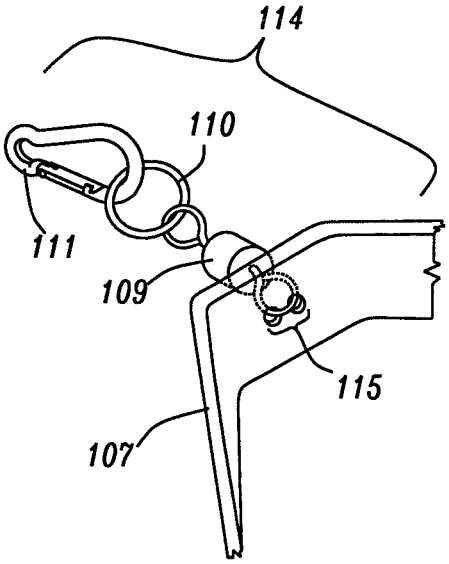
FIG. 5A illustrates a second embodiment of the bracket connection subassembly.
Figure 5B:
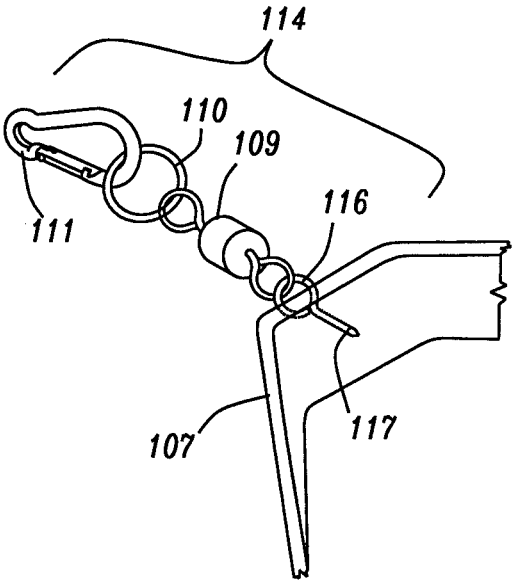
FIG. 5B illustrates a third embodiment of the bracket connection subassembly.

FIG. 5A illustrates a second embodiment of the pin bearing-bracket connection within connection sub-assembly 114. Two holes 115 are drilled into bracket 107. The loop on one end of pin bearing 109 goes through each hole 115 to hold the loop to the bracket and to complete the loop back to the pin bearing. FIG. 5B illustrates a third embodiment of the pin bearing-bracket connection within connection sub-assembly 114. An eyebolt 116 is screwed into a threaded hole 117 in bracket 107. The loop on one end of pin bearing 109 connects to eyebolt 116.

Figure 2B:
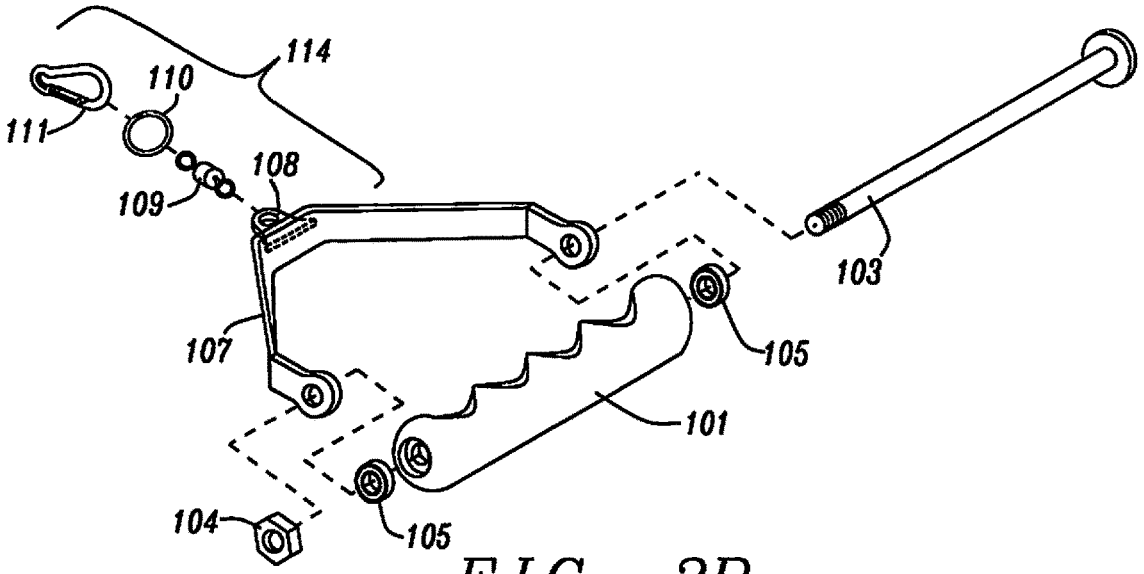
FIG. 2B illustrates an exploded view of the preferred embodiment in FIG. 2A of the present disclosure.

FIG. 2B illustrates an exploded view of the total assembly, with dashed lines demonstrating how each piece connects.

Figure 3A:
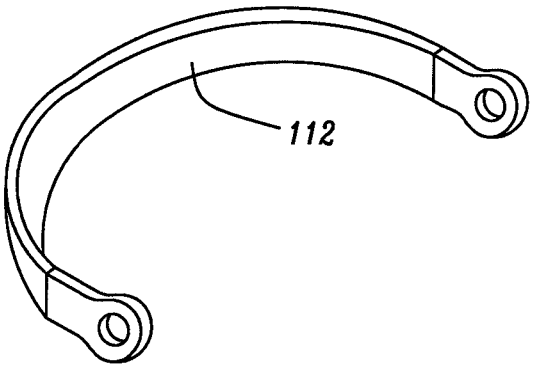
FIG. 3A illustrates a second embodiment of the bracket of the present disclosure.
Figure 3B:
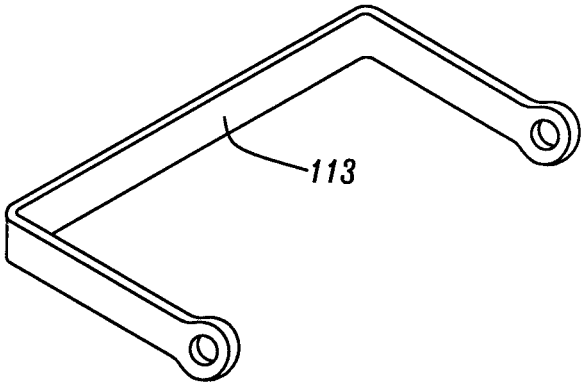
FIG. 3B illustrates a third embodiment of the bracket of the present disclosure.

FIG. 3A and FIG. 3B illustrate two alternative bracket shapes, although other geometrical shapes are possible. FIG. 3A discloses a semi-circular bracket, whereas FIG. 3B shows a rectangular bracket.

Figure 4:
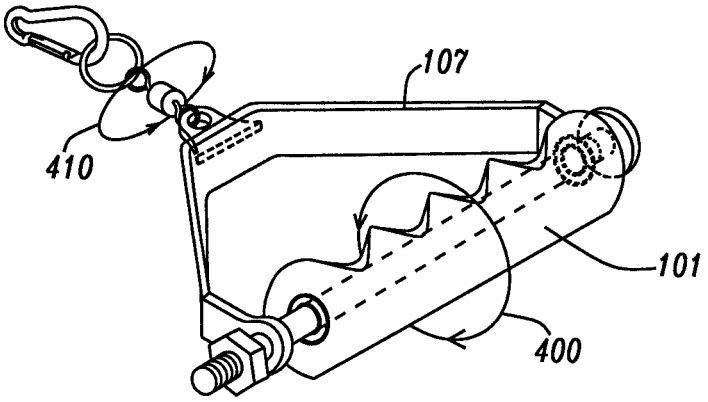
FIG. 4 illustrates the two degrees of freedom which the present disclosure allows.

In an important feature of the disclosure, FIG. 4 illustrates the two degrees of freedom of the handle and of the bracket. The handle 101 can freely spin 400 along its axis 360 degrees in either direction, where the handle's axis of rotation is perpendicular to the direction of cable tension. The bracket 107 can freely spin 410 in line with the cable 360 degrees in either direction, where the bracket's axis of rotation is in the same direction as the cable tension.

Figure 6A:
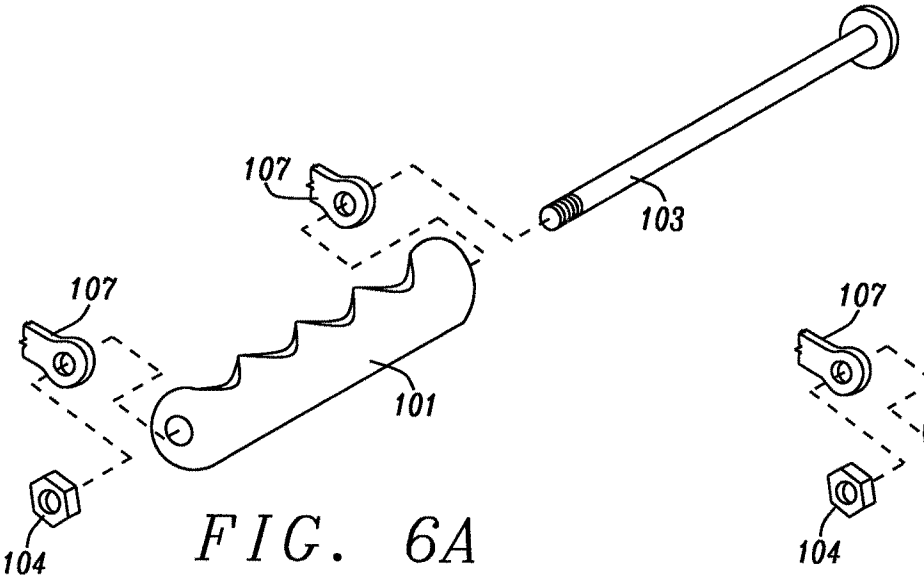
FIG. 6A illustrates an exploded view of the second embodiment of the handle attachment of the present disclosure.
Figure 6B:
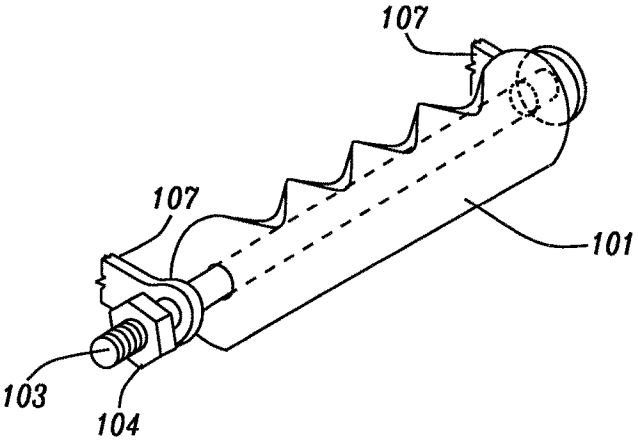
FIG. 6B illustrates a perspective view of the second embodiment of the handle attachment of the present disclosure.

FIG. 6A and FIG. 6B illustrate a second embodiment of the handle attachment. This embodiment also excludes bearings. Threaded rod 103 slides through bracket 107, through handle 101 which is drilled to a clearance fit, and through the other end of bracket 107, and is tightened in place by nut 104. In use, handle 101 freely spins around threaded rod

103. FIG. 6A is an exploded view of the total assembly, with dashed lines demonstrating how each piece connects. FIG. 6B is a perspective view of the total assembly fully assembled. In this embodiment, the grip also may be disassembled by a user in order to attach a different grip which better fits the user's hand.

Figure 7A:
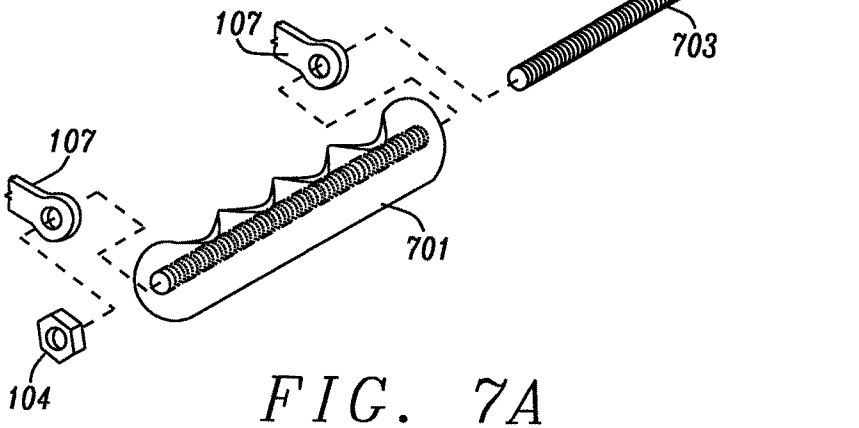
FIG. 7A illustrates an exploded view of the third embodiment of the handle attachment of the present disclosure.
Figure 7B:
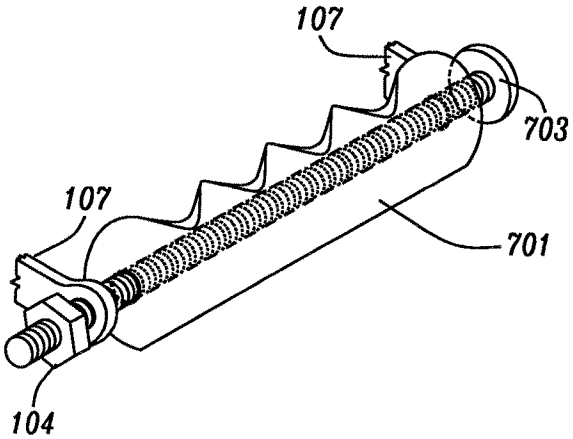
FIG. 7B illustrates a perspective view of the third embodiment of the handle attachment of the present disclosure.

FIG. 7A and FIG. 7B illustrate a third embodiment of the handle attachment. This embodiment excludes the bearings. Instead, fully threaded rod 703 slides through bracket 107, screws through handle 701 which is threaded inside, through the other end of bracket 107, and is tightened in place by nut 104. In use, handle 701 spins freely around fully threaded rod 703 and translates slightly in rotation. FIG. 7A is an exploded view of the total assembly, with dashed lines demonstrating how each piece connects. FIG. 7B is a perspective view of the total assembly. The grip may be disassembled by a user in order to attach a different grip which better fits the user's hand.

One advantageous feature of the FIG. 6A, FIG. 6B and FIG. 7A, FIG. 7B handles is that both of these handle attachment variations may be easily disassembled by a user, in order to attach a different grip. This provides a range of possibilities including grips that fit better into different sized hands, or grips that can be used for exercise variations. In a similar way, grips with a varying location and size of grip indentations can be used, as well as those with variations in the smoothness, or roughness, of the grip material.

The exercise equipment handle of the disclosure has several advantages, including an increase in user comfort, and allowing wrist flexion and extension and forearm supination and pronation in order to build muscle and prevent injury.

The handle is made to be ergonomic, to feel more comfortable to grip than currently available handles. Preferably, the handle has indentations along its length for each of the four forefingers, as shown in each of the above figures. The handle can rotate about its longitudinal axis and may be connected to the bracket in multiple ways. A preferred embodiment includes two bearings, one on each end of the grip, which provide rotation without resistance.

A further alternative is to thread the inside of the grip and screw it onto a corresponding threaded rod.

A further alternative is use a hollow cylinder within the grip which slides freely over a solid rod with a clearance fit between the hollow and the rod.

A preferred embodiment for the handle material is a flexible material such as rubber or silicon. Alternately a metal such as steel or aluminum could be used. A further alternative is a sturdy non-metal such as plastic.

The grip 101 is attached to a bracket 107/112/113. In a preferred embodiment, the bracket material is a sturdy metal such as steel or aluminum.

Figure 1:
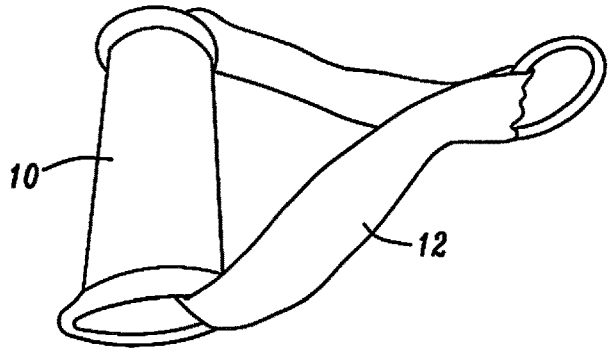
FIG. 1 (Prior Art)
FIG. 1 illustrates a typical strap based handle of the prior art.

The preferred bracket shape is triangular, as shown in FIGS. 1A and 2A. Alternative shapes include the semi-circular shape of FIGS. 1B and 2B, or the rectangular shape of FIGS. 1C and 2C.

The bracket culminates, preferably, in a welded eye ring, part of a connection sub-assembly 114. The preferred embodiment of a connection is a pin bearing. The pin bearing hooks into the eye ring. The bearing allows the user to pronate and supinate the forearm with no resistance. A further alternative embodiment within the connection sub-assembly 114 is a torsional spring with loops on either end. One loop connects to the welded eye ring. This embodiment provides a controllable amount of resistance to forearm supination and pronation. A metal ring connects to the far end of the connection. A carabiner, which is standard in cable exercise equipment, clips into the metal ring.

Although the preferred embodiment of the present disclosure has been illustrated, and that form has been described in detail, it will be readily understood by those skilled in the art that various modifications may be made therein without departing from the spirit of the disclosure or from the scope of the appended claims.

What is claimed is:

1. An exercise equipment handle for connecting to cable-based exercise equipment, comprising:

a grip;

a bracket, wherein said grip is rotatably coupled to said bracket; and a rotatable connection assembly connected to said bracket, wherein said rotatable connection assembly comprises:

a pin bearing; and an eye ring at each end of said pin bearing and wherein said rotatable connection assembly is connected said bracket two drilled holes;

wherein after connection to said cable-based exercise equipment and when in use, said rotatable connection assembly freely rotates along a first axis parallel to its connection to said cable-based exercise equipment, and wherein said grip freely rotates along a second axis perpendicular to said first axis.

2. The exercise equipment handle of claim 1, wherein said grip encompasses two bearings, one on each end of said grip.

3. The exercise equipment handle of claim 1 wherein said grip encompasses a threaded rod.

4. The exercise equipment handle of claim 1 wherein said grip comprises clearance fit between the grip and a rod.

5. The exercise equipment handle of claim 1 wherein said bracket has a triangular shape.

6. The exercise equipment handle of claim 1 wherein said bracket has a semi-circular or rectangular shape.

7. The exercise equipment handle of claim 1 wherein said grip further comprises four depressions, one for each forefinger of a user.

* * * * *